US009986614B2

(12) United States Patent
Verbrugh et al.

(10) Patent No.: US 9,986,614 B2
(45) Date of Patent: May 29, 2018

(54) CONTROLLER FOR LIGHT-EMITTING DEVICES

(75) Inventors: Stefan Marcus Verbrugh, Eindhoven (NL); Ralph Kurt, Eindhoven (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 85 days.

(21) Appl. No.: 14/232,622

(22) PCT Filed: Jul. 5, 2012

(86) PCT No.: PCT/IB2012/053437
§ 371 (c)(1),
(2), (4) Date: Jan. 14, 2014

(87) PCT Pub. No.: WO2013/011405
PCT Pub. Date: Jan. 24, 2013

(65) Prior Publication Data

US 2014/0184101 A1 Jul. 3, 2014

Related U.S. Application Data

(60) Provisional application No. 61/508,131, filed on Jul. 15, 2011.

(51) Int. Cl.
*H05B 33/08* (2006.01)

(52) U.S. Cl.
CPC ..... *H05B 33/0863* (2013.01); *H05B 33/086* (2013.01)

(58) Field of Classification Search
CPC . H05B 33/0863; H05B 33/086; H05B 33/057
(Continued)

(56) References Cited

U.S. PATENT DOCUMENTS 7,772,757 B2 * 8/2010 Kane et al. ..... 313/498
7,791,649 B2 * 9/2010 Kim et al. ..... 348/223.1
(Continued)

FOREIGN PATENT DOCUMENTS

WO 2007116349 A1 10/2007
WO 2009076771 A1 6/2009
(Continued)

*Primary Examiner* — Douglas W Owens
*Assistant Examiner* — Jianzi Chen
(74) *Attorney, Agent, or Firm* — Akarsh P. Belagodu

(57) ABSTRACT

The present invention relates to a controller (30) for controlling the light-output of two light-emitting devices (10, 20). The two light-emitting devices are adapted to provide a McCandless effect on an illuminated object (40). The controller (30) comprises a first user interface for a user to set a first color (11) to be output by a first light-emitting device (10) and second user interface for a user to set a desired mixed color (81) of a common area (80) being illuminated by both light-emitting devices (10, 20). The controller (30) further comprises a processing circuitry for determining first lighting parameters resulting in said first color (11) when provided to the first light-emitting device (10), and for determining second lighting parameters resulting in a second color (21) when provided to a second light-emitting device (20). A mix of the first color (11) and the second color (21) provides the mixed color (81). The first color (11) and the mixed color (81) are represented in a color space chromaticity diagram such that they define a line and the second color (21) is determined such that it is located on said line in the color space chromaticity diagram on an opposite side of the desired mixed color (81) relative to the first color (11). Further, the second color (21) is determined by the processing circuitry such that the desired mixed color (81) is achieved when the first (11) and the second (21) colors are mixed.

8 Claims, 2 Drawing Sheets

(58) Field of Classification Search
USPC ..... 315/291–311, 149–159
See application file for complete search history.

(56) References Cited

U.S. PATENT DOCUMENTS

| | | | | |
|---|---|---|---|---|
| 7,868,562 | B2 * | 1/2011 | Salsbury et al. | 315/307 |
| 8,084,948 | B2 * | 12/2011 | Van Der Veen | H05B 41/3921 315/151 |
| 8,319,455 | B2 * | 11/2012 | Bennette | 315/312 |
| 8,330,383 | B2 * | 12/2012 | Man et al. | 315/247 |
| 8,779,669 | B2 * | 7/2014 | Ramer et al. | 315/153 |
| 8,796,952 | B2 * | 8/2014 | Van de Ven | H05B 33/0827 315/297 |
| 8,853,971 | B2 * | 10/2014 | Bennette | H05B 33/0863 315/185 S |
| 8,981,672 | B2 * | 3/2015 | Krause | 315/307 |
| 2007/0235639 | A1 * | 10/2007 | Rains, Jr. | H05B 33/0863 250/228 |
| 2009/0147154 | A1 * | 6/2009 | Arai et al. | 348/750 |
| 2011/0116259 | A1 * | 5/2011 | Plonski | A47F 11/06 362/231 |
| 2012/0169238 | A1 * | 7/2012 | Lenderink | 315/151 |

FOREIGN PATENT DOCUMENTS

| | | | |
|---|---|---|---|
| WO | 2011036612 | A1 | 3/2011 |
| WO | 2011066543 | A1 | 6/2011 |

* cited by examiner

CONTROLLER FOR LIGHT-EMITTING DEVICES

FIELD OF THE INVENTION

The present invention relates to a controller for light-emitting devices, and especially to a controller adapted to control the color of the light in light-emitting devices.

BACKGROUND OF THE INVENTION

The McCandless method is used to enhance the 3D effect on stage in theatres. A certain area of the stage is illuminated by two light-emitting lighting fixtures, one from the left and one from the right. Often these lighting fixtures are placed under an angle of 90 degrees. One lighting fixture emits light in a cool color (blue, violet or white with a high color temperature, Tc) and the other lighting fixture emits light with a warm color (amber, pink or white with low Tc). The areas where the cool light beam creates shadows are illuminated by the warm beam and hence the depth of the object (e.g. face of an actor) is exaggerated. This enhances the 3D nature of the object on stage.

A lighting designer may decide to exaggerate this effect on stage to create more drama. If for example an actor is illuminated by a warm color from one side and by a cool color from the other side, warm and cool shadows occur on the face of the actor. Playing with these shadows is an important tool for the lighting designer to enhance or reduce the depth (3D effect).

Behind the object that is illuminated, there will be areas where the cool color and warm color each illuminates a background on the stage. Further, there will be an area illuminated by both the colors providing a mixed light. The lighting designer may want to control the color of the mixed light to use as a lighting effect on stage behind the object.

To reach a certain mixed light color, the lighting designer will need to experiment with the two colors from the lighting fixtures, which two colors will both provide a McCandless effect and provide the wanted mixed light color. This may be very complicated and time consuming.

Consequently, there is a need for an aid to a lighting designer in arranging light-emitting lighting fixtures in a theatre such that the lighting designer may control both the McCandless effect and the mixed light color.

SUMMARY OF THE INVENTION

It is an object of the present invention to overcome this problem, and to provide an aid for a lighting designer to control light-output of light-emitting devices.

According to a first aspect of the invention, this and other objects are achieved by a controller for controlling a light-output of a first light-emitting device and a second light-emitting device arranged to simultaneously illuminate an object. The controller comprises a first user interface for allowing a user to set a first color to be output by the first light-emitting device, a second user interface for allowing a user to set a desired mixed color of a common area behind said object being illuminated by both said first light-emitting device and said second light-emitting device, and processing circuitry connected to the first user interface and the second user interface. The processing circuitry is configured to determine first lighting parameters resulting in said first color when provided to the first light-emitting device, and determine second lighting parameters resulting in a second color when provided to the second light-emitting device.

The second color is determined such that the desired mixed color is achieved when the first and the second color are mixed, and such that the first color and the mixed color are located in a color space chromaticity diagram such that they define a line and the second color is located on said line in the color space chromaticity diagram on an opposite side of the desired mixed color relative to the first color. The controller further comprises a light-emitting device interface for providing the first lighting parameters to the first light-emitting device and the second lighting parameters to the second light-emitting device.

A lighting designer may thereby always get a McCandless effect with the set first color, and at the same time be able to control the mixed color. The mixed color may comprise a mix of the first color and the second color. On a stage of a theatre, the lighting designer may change the mixed color without the risk of losing the McCandless effect provided by the first and the second light-emitting devices. The controller may enable a large amount of possible colors to be output from the light-emitting devices. The lighting designer may have a large freedom in choosing the color to be output from the first light-emitting device and the resulting mixed color of the first and the second color. The light-emitting devices may be LED devices that may be able to provide an output color of basically any color. The controller may control the output of the LED devices such that a lighting designer may be able to utilize the possibilities of the LED devices.

The three colors may be represented by a respective value in a color space chromaticity diagram. The mixed color may be set providing a point value representation in the color space chromaticity diagram. The first color may be set providing a point value representation in the color space chromaticity diagram, e.g. a warm color, such that the point value representing the first color and the point value representing the mixed color together may define a line. The second color may be determined such that it may be represented in the color space chromaticity diagram by a point value on the line and on an opposite side of the point value of the mixed color with respect to the point value of the first color. If the set first color is changed, the point value representation for the first color may be moved, changing direction of the line defined by the first color and the mixed color representations. The processing circuitry may thereby recalculate the second lighting parameters such that the point value representation in the color space chromaticity diagram for the second color may continue to be on the line and on the opposite side of the mixed color value with respect to the first color value. The second lighting parameters may thereby be recalculated such that the McCandless effect is kept.

The controller may in one embodiment be connected to a computer, and the computer may be programmed to control the set first color and the set mixed color. The computer may be programmed to, over a period of time, change the values for the first color and the mixed color in a desired pattern. During the period of time, the controller may continuously recalculate the second lighting parameters such that a suitable second color continuously is achieved.

In one embodiment, the distances between the mixed color to the respective first and second color in the color space chromaticity diagram may be substantially equal.

If the light intensities of both light-emitting devices, and distances of both light-emitting devices to the illuminated object, are equal, the distances between the point values representations of the mixed color to the respective first and second color may be equal. This provides a constant McCandless effect. If the light intensities, and/or distance to the illuminated object, of the two light-emitting devices differ, the processing circuitry may compensate for the difference. The compensation may be by determining second lighting parameters that correspond to a second color point value representation in the diagram that is of different distance to the mixed color representation relative to the distance from the mixed color representation to the first color representation.

In one embodiment, the first color may be adapted to be set to a first color space chromaticity value, and the mixed color may be configured to be set to a mixed color space chromaticity value, wherein the processing circuitry may be configured to determine the second color as a second color space chromaticity value by subtracting the first color space chromaticity value from the mixed color space chromaticity value.

All colors may be represented by a value in a color space chromaticity diagram. The processing circuitry may be adapted to determine the second color based on color space chromaticity values for the first color and the mixed color. A mathematical calculation of the colors may thereby be achieved. The first and second user interfaces may be used to set a color space chromaticity value for the respective colors. The color space chromaticity value for the second color may be determined by the processing circuitry through a mathematical calculation based on the color space chromaticity values for the first color and the mixed color.

Furthermore, in one embodiment the first and second light-emitting devices may be LED devices, each comprising light-emitting diodes in a number of n colors, wherein the processing circuitry may be configured to determine the second color B of the second light-emitting device by determining a light-intensity value for each of the n colors of light-emitting diodes in the second light-emitting device, wherein the processing circuitry further may be configured to determine light-intensity values for each of the n colors in the set first color A and mixed color C, and wherein the processing circuitry may be configured to determine the light-intensity value for each i:th color among the n colors for the second color B in the second light-emitting device by $B_i=C_i-A_i$.

The LED device may be a LED lighting fixture that may be able to emit basically any color. The LED device may comprise light-emitting diodes in a plurality of colors that together may be mixed to emit light of a certain color from the LED device. By expressing the color of the set first color and mixed color as light-intensity values for each color of light-emitting diodes, the determination of color B may be performed for each color of light-emitting diodes and directly applicable as light-intensity values on the light-emitting diodes in the second LED device. The light-intensity values for the set colors and the calculated color may further depend on the amount of light-emitting diodes of each color in the first and second LED devices. The first and second LED devices may advantageously comprise an equal number of light-emitting diode colors, and an equal number of light-emitting diodes of each color.

In another embodiment, the mixed color may be a white color and the second user interface may be configured for a user to set a desired color temperature of the mixed color.

A lighting designer may use the mixed color light as a lighting effect. In many cases a white mixed color is desired to illuminate a background behind the object to be illuminated. However, white light of different color temperature may have different effect in a lighting arrangement. Thereby, the lighting designer may have use of the possibility to set the color temperature of the white mixed color. The mixed color may be bound to be represented in a white color area in the color space chromaticity diagram.

In a further embodiment, the controller may be configured to compensate for light intensity differences from each of the light-emitting devices based on the distance from each of the light-emitting devices to the object to be illuminated, such that light from each of the light-emitting devices that may reach the object to be illuminated are of equal intensity.

Thereby, the controller may be able to compensate for a difference in distance to the stage in a theatre between the first and the second light-emitting device. This consideration may further affect the determination of the second lighting parameters provided to the second light-emitting device. The compensation for the difference in distance to the illuminated object from each of the two light-emitting devices may be represented in the color space chromaticity diagram by a difference in distance between the representation of the mixed color to the representations of each of the first and second color.

In one embodiment, the controller may be integrated with one of the first and the second light-emitting devices and may be connected to the other of the first and second light-emitting devices.

Thereby, a more compact lighting arrangement may be achieved wherein a lighting designer may set the first color and the mixed color directly at one of the light-emitting devices. The controller may be connected to the other light-emitting device through a wire or through a wireless connection.

Alternatively, in one embodiment, the controller may comprise a transmitter configured for wireless connection with the first and second light-emitting devices.

The controller may be adapted to send the lighting parameters to the light-emitting devices wirelessly. The controller may thereby comprise a transmitter for wireless communication. Such controller may thereby be adapted for wireless connection with light-emitting devices that comprise a receiver for receiving the wireless signals from the controller. This may provide a larger freedom for a lighting designer when operating the controller. The lighting designer may be free to move in the illuminated areas when setting the colors on the controller.

Moreover, the controller according to various embodiments of the present invention may advantageously be comprised in a lighting arrangement further comprising a first light-emitting device and a second light-emitting device, each being connected to the controller. The controller may control light-output of the first and second light-emitting devices. The first and second light-emitting devices may be connected to the controller through the light-emitting device interface of the controller.

It is noted that the invention relates to all possible combinations of features recited in the claims.

BRIEF DESCRIPTION OF THE DRAWINGS

The various aspects of the invention, including its particular features and advantages, will be readily understood from the following detailed description and the accompanying drawings, in which.

DETAILED DESCRIPTION

Figure 1:
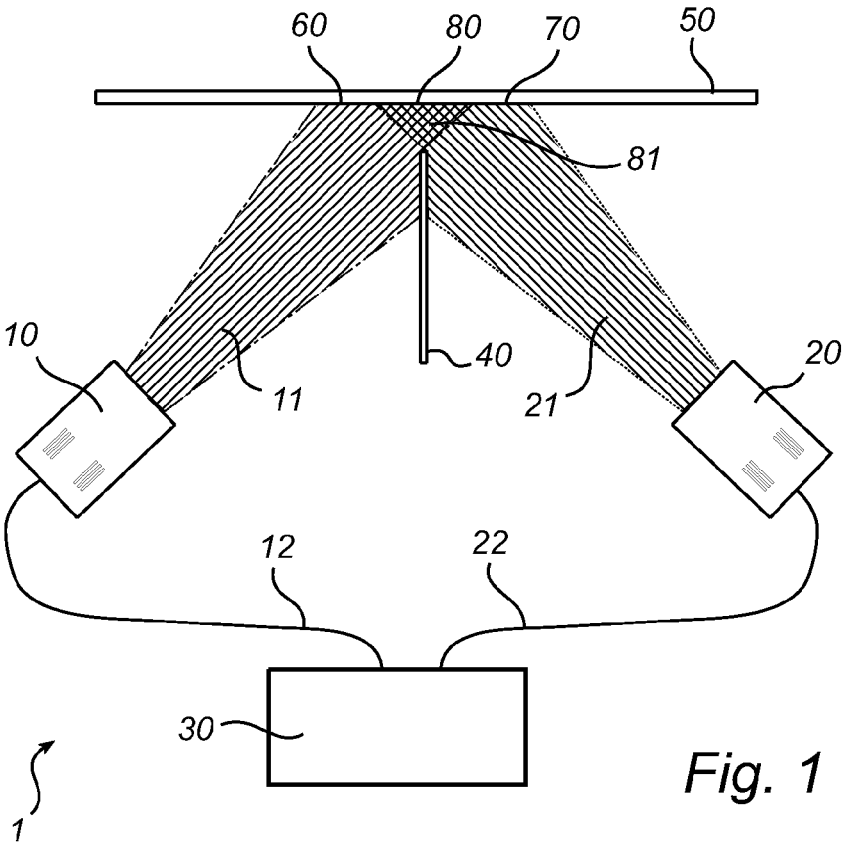
FIG. 1 illustrates a lighting arrangement comprising a controller according to an embodiment of the present invention.

The present invention will now be described more fully hereinafter with reference to the accompanying drawings, in which currently preferred embodiments of the invention are shown. This invention may, however, be embodied in many different forms and should not be construed as limited to the embodiments set forth herein; rather, these embodiments are provided for thoroughness and completeness, and fully convey the scope of the invention to the skilled person. Like reference characters refer to like elements throughout.

Figure 2:
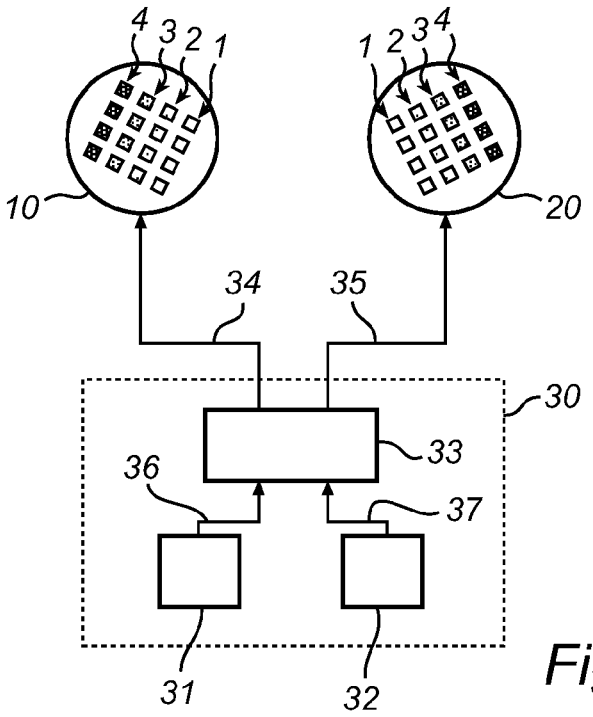
FIG. 2 shows a schematic block diagram.

FIGS. 1 and 2 illustrate an lighting arrangement 1 according to an embodiment. The lighting arrangement 1 comprises two lighting fixtures 10, 20, both connected to a controller 30. The lighting fixtures 10, 20 are arranged with an angle to each other. The lighting fixtures 10, 20 are arranged to illuminate an object 40. The object could be a person on a stage. To achieve a McCandless effect on the object 40 by means of the illumination by the two lighting fixtures 10, 20, the first lighting fixture 10 provides a first color 11 on one side of the object 40, and the second lighting fixture 20 provides a second color 21 on another side of the object 40. One of the first color 11 and the second color 21 is a warm color and the other one is a cool color.

The light from the lighting fixtures 10, 20 that does not illuminate the object 40 will illuminate a background 50 located behind the object 40. A first area 60 on the background 50 will be illuminated by light of the first color 11 from the first lighting fixture 10. A second area 70 on the background 50 will be illuminated by light of the second color 21 from the second lighting fixture 20. Between the first area 60 and the second area 70, there will be a mix area 80 which light from both the first 10 and the second 20 lighting fixture will illuminate. The first color 11 and the second color 21 will be mixed in the mixed area 80 to a mixed color 81.

The controller 30 is connected to the first lighting fixture 10 and to the second lighting fixture 20 via respective cables 12, 22. Alternatively, the controller 30 may be integrated in one of the lighting fixtures 10, 20 and connected to the other lighting fixture. In a further alternative embodiment, the controller 30 may be wirelessly connected to the lighting fixtures 10, 20.

As further seen in FIG. 2, the controller 30 controls the first color 11 in the first lighting fixture 10 and the second color 21 in the second lighting fixture 20. The colors 11, 21 are controlled by the controller 30 sending first lighting parameters 34 to the first lighting fixture 10 and second lighting parameters 35 to the second lighting fixture 20. The respective lighting parameters 34, 35 are selected to provide a specific color from the respective lighting fixture 10, 20.

The controller 30 comprises a first user interface 31 and a second user interface 32. The first user interface 31 is adapted for a user to set the first color 11. The second user interface 32 is adapted for a user to set the mixed color 81. The user, e.g. a lighting designer, may set the mixed color 81 to a certain color in order to use it as a lighting effect. The user may further set the first color 11 in order to provide a wanted color scheme on the illuminated object 40.

The controller 30 further comprises processing circuitry 33 configured to receive input signals 36, 37 from the first and second user interfaces 31, 32. The processing circuitry 33 determines the first lighting parameters 34 based on the input signal 36 from the first user interface 31. The first lighting parameters 35 are determined to provide the first color 11 set in the first user interface 31 when supplied to the first lighting fixture 10. The processing circuitry 33 further determine the second lighting parameters 36 based on the input signal 36 from the first user interface 31 and the input signal 37 from the second user interface 32. The second lighting parameters 35 are determined to provide the second color 21 when supplied to the second lighting fixture 20. The second lighting parameters 35 are further determined to provide the mixed color 81 in the mixed area 80 when supplied to the second lighting fixture 20, wherein the wanted mixed color 81 is set in the second user interface 32.

The second lighting parameters 35 are further determined such that the McCandless effect is achieved when the second color 21 illuminates one side of the illuminated object 40 at the same time as light of the first color 11 illuminates another side of the object 40.

Figure 3A:
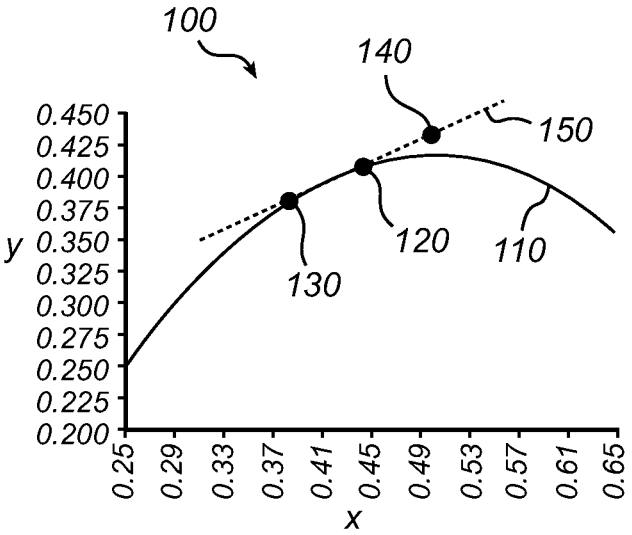
FIGS. 3*a* and *b* show a color space chromaticity diagram.

The suitable second color 21 to achieve the McCandless effect at the same time as the first color 11 and the mixed color 81 are set is described in a color space chromaticity diagram 100 (CIE1931 x, y diagram) as illustrated in FIG. 3. The values on the axes represent coordinates of color points (x,y). The curved line 110 in the diagram 100 represents white light of different color temperature in the color space chromaticity diagram 100 and may be referred to as a Black Body Line (BBL) 110. In FIG. 3*a*, a point value 120 in the middle represents the mixed color 81 set by the user in the second user interface 32. The mixed color 81 is in the shown example set along the BBL 110. In one embodiment, the mixed color 81 may be restricted to be set along the BBL 110, providing the second user interface 32 to set the color temperature of the mixed white light 81. In an alternative embodiment, the mixed color 81 may be set to any color.

A point value 130 to the left in FIG. 3*a* represents the set first color 11. In this example, the first color 11 is also set to a white light, but of another color temperature compared to the mixed color 81. The two point values 120, 130 representing the mixed color 81 and the first color 11 respectively, together define a line 150 in the color space chromaticity diagram 100. The processing circuitry 33 in the controller 30 determines the second lighting parameters 35 for the second color 21 such that a point value 140 representing the second color 21 in the diagram 100 is located on the line 150 and on an opposite side of the point value 120 representing the mixed color 81 relative to the point value 130 representing the first color 11. Further, the second lighting parameters 35 for the second color 21 are determined such that the distance between the point value 120 representing the mixed color 81 and the point value 140 representing the second color 21 is equal to the distance between the point value 120 representing the mixed color 81 and the point value 130 representing the first color 11. The alignment of the point value 140 representing the second color 21 on the line 150 and with the described distance to the point value 120 representing the mixed color 81 provides a second color 21 that together with the first color 11 provides the McCandless effect on the illuminated object 40. In the example shown in FIG. 3*a*, the first color 11 will have a higher color temperature than the second color 21. The first color 11 will thereby be provided as a cool color, and the second color 21 as a corresponding warm color.

Figure 3B:
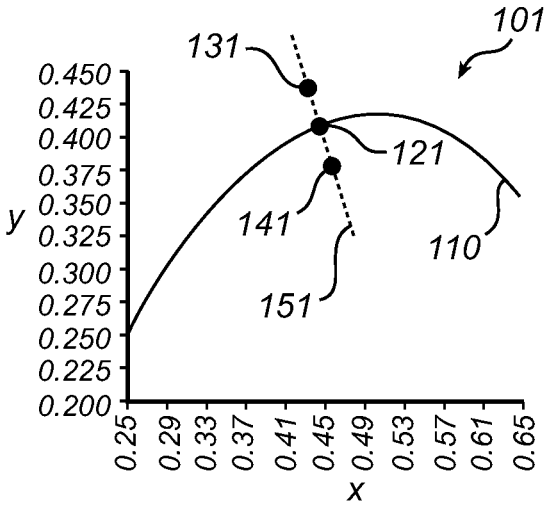

FIG. 3*b* illustrates an alternative example wherein the first user interface 31 is set to provide a first color 11 represented by a point value 131 separate from the BBL 110. The second lighting parameters 35 are thereby determined to provide a second color 21 represented by a point value 141 which is still located on a line 151 defined by the point value 121 representing the mixed color 81 and the point value 131 representing the first color 11, and on an opposite side of the point value 121 representing the mixed color 81 relative to the point value 131 representing the first color 11. By determining the second lighting parameters 35 to provide the second color 21 as represented by the point value 141 in the color space chromaticity diagram 101, the McCandless effect will be achieved on the illuminated object 40 as well as the set first color 11 and mixed color 81.

Referring back to FIG. 2, each of the lighting fixtures 10, 20 comprises LEDs of a plurality of colors. The lighting fixtures 10, 20 each comprise a set of LEDs of each color. In the illustrated example, each lighting fixture 10, 20 comprises four sets 1, 2, 3, 4 of LEDs of different colors. The first lighting parameters 34 supplied to the first lighting fixture 10 from the controller 30 instruct the lighting fixture 10 to operate each set 1, 2, 3, 4 of LEDs such that the light combined by all LEDs in the first lighting fixture 10 together achieves the set first color 11. The second lighting parameters 35 supplied to the second lighting fixture 20 from the controller 30 instruct the lighting fixture 20 to operate each set 1, 2, 3, 4 of LEDs such that the light combined by all LEDs in the second lighting fixture 20 together achieves the calculated second color 21.

In the controller 30, the determination of the first lighting parameters 34 are based on the number of color sets 1, 2, 3, 4 of LEDs in the first lighting fixture 10. If indicating parameters for the set first color 11 with the letter A, the processing circuitry 33 will determine parameters for each of the color sets 1, 2, 3, 4 such that $A=A_1+A_2+A_3+A_4$ when the first lighting fixture 10 comprises LEDs of four different colors. If indicating parameters for the set mixed color 81 with the letter C, the processing circuitry 33 will determine parameters for each of the color sets 1, 2, 3, 4 such that $C=C_1+C_2+C_3+C_4$ when the first 10 and the second lighting fixture 20 comprises LEDs of four different colors. If indicating parameters for the determined second color 21 with the letter B, the processing circuitry 33 will determine parameters for each of the set 1, 2, 3, 4 of LEDs in the second lighting fixture 20 such that $B=B_1+B_2+B_3+B_4$ and $B_i=C_i-A_i$, wherein i=1, 2, 3, 4 when the second lighting fixture 20 comprises LEDs of four different colors. Generally speaking, the second lighting parameters 35 comprises $B_i=C_i-A_i$, for i=1 . . . n, wherein n equals the number of sets of LEDs of different colors in the second lighting fixture 20. $A_i$ and $C_i$ are determined based on the settings in the first 31 and the second 32 user interfaces respectively.

The person skilled in the art realizes that the present invention by no means is limited to the preferred embodiments described above. On the contrary, many modifications and variations are possible within the scope of the appended claims. For example, the number of sets of LEDs of different colors in the lighting fixtures may vary. Further, first and second user interfaces may be varied in possibilities for the user to set the first color and the mixed color.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage.

The invention claimed is:

1. A controller for controlling a light-output of a first light-emitting device and a second light-emitting device arranged to simultaneously illuminate an object, the controller comprising:

a first user interface for allowing a user to set a first color to be output by the first light-emitting device;

a second user interface for allowing a user to set a desired mixed color of a common area behind said object being illuminated by both said first light-emitting device and said second light-emitting device, said first and second light-emitting devices configured to illuminate first and second areas, respectively, adjacent to said common area, where said first area is illuminated by said first light-emitting device but not said second light-emitting device and said second area is illuminated by said second light-emitting device but not said first light-emitting device, the second user interface being configured to restrict the desired mixed color to be set along a black body line in a color space chromaticity diagram; and processing circuitry connected to the first user interface and the second user interface, and configured to:

determine first lighting parameters resulting in said first color when provided to the first light-emitting device, determine second lighting parameters resulting in a second color when provided to the second light-emitting device, said second color being such that the desired mixed color is achieved when the first and the second colors are mixed, and such that the first color and the mixed color are represented in the color space chromaticity diagram such that they define a straight line and the second color is represented on said straight line in the color space chromaticity diagram on an opposite side of the desired mixed color relative to the first color, and output the first lighting parameters to the first light-emitting device and the second lighting parameters to the second light-emitting device.

2. The controller according to claim 1, wherein the distances between the mixed color to the respective first and second color in the color space chromaticity diagram are substantially equal.

3. The controller according to claim 1, wherein the first color is represented by a first color space chromaticity value, and the mixed color is represented by a mixed color space chromaticity value, wherein the processing circuitry is configured to determine the second color as a second color space chromaticity value by subtracting the first color space chromaticity value from the mixed color space chromaticity value.

4. The controller according to claim 1, wherein the first and second light-emitting devices are LED devices, each comprising light-emitting diodes in a number of n colors, wherein the processing circuitry is configured to determine the second color of the second light-emitting device by determining a light-intensity value for each of the n colors of light-emitting diodes in the second light-emitting device, wherein the processing circuitry further is configured to determine light-intensity values for each of the n colors in the set first color and mixed color, and wherein the processing circuitry is configured to determine the light-intensity value for each i:th color among the n colors for the second color in the second light-emitting device by Bi=Ci−Ai, wherein A indicates parameters for the set first color, B indicates parameters for the determined second color, C indicates parameters for the set mixed color, n equals the number of sets of LEDs of different colors in the second lighting fixture, and i=1, . . . , n.

5. The controller according to claim 1, wherein the mixed color is a white color and the second user interface is configured for a user to set a desired color temperature of the mixed color.

6. The controller according to claim 1, wherein the controller is integrated with one of the first and the second light-emitting devices and connected to the other of the first and second light-emitting devices.

7. The controller according to claim 1, further configured for wireless connection with the first and second light-emitting devices.

8. A lighting arrangement, comprising:

a first light-emitting device;

a second light-emitting device; and the controller according to claim 1 connected to the first light-emitting device and the second light-emitting device for controlling light-output of the first and second light-emitting devices.

* * * * *